United States Patent [19]

Rystad

[11] Patent Number: 4,484,411

[45] Date of Patent: Nov. 27, 1984

[54] ADJUSTABLE SHOWER DOOR JAMB ASSEMBLY

[75] Inventor: Arnold O. Rystad, Kelseyville, Calif.

[73] Assignee: Work Right Products, Inc., Oakland, Calif.

[21] Appl. No.: 386,923

[22] Filed: Jun. 10, 1982

[51] Int. Cl.[3] ..... E06B 1/04

[52] U.S. Cl. ..... 49/505; 52/212

[58] Field of Search ..... 49/505, 480, 481; 52/212

[56] References Cited

U.S. PATENT DOCUMENTS 3,039,156 6/1962 Morris, Jr. et al. ..... 49/481

3,553,891 1/1971 Casebolt et al. ..... 49/505

*Primary Examiner*—Kenneth Downey

*Attorney, Agent, or Firm*—Bruce & McCoy

[57] ABSTRACT

A shower door jamb assembly is comprised of a separate latch jamb member having a perpendicularly extending leg portion and jamb support wherein the jamb support includes a jamb support base, which adjustably holds the jamb member, and a mounting frame structure. The jamb support base has a transversely oriented receiving slot extending laterally through the base to releasably hold and constrain the movement of the extending leg portion of the latch jamb member. Adjustment screws releasably secure the latch jamb member within the jamb support base receiving slot whereby the latch jamb member, by a transverse plane adjustment, can be made to conform to the plane of the shower door before the latch jamb is secured into a fixed, completely installed position.

11 Claims, 9 Drawing Figures

ADJUSTABLE SHOWER DOOR JAMB ASSEMBLY

BACKGROUND OF THE INVENTION

The present invention relates generally to hardware used in the installation of shower stalls, and particularly to a shower door jamb, (also referred to as a latch jamb) which has the object of providing flush, sealing contact along the glass shower door when the shower door is closed. It is generally the purpose of a shower stall construction to provide a water tight enclosure which can be fabricated and installed with relative ease and economy.

When installing a shower door assembly in a bathroom, caution must be taken to compensate for out-of-plumb conditions of the supporting wall surfaces and to align the stall hardware and panels. Particularly, the door suspending hinge jamb and the latch jamb, once installed, must be properly aligned, so that the swinging edge of the shower door will properly seal against the latch jamb; otherwise water leakage will occur.

Heretofore, when installing a shower door the hinge jamb for hanging the shower door was first installed mating channel piece, such as a corner post of the stall or wall channel anchored to an adjacent wall by means of expansion plugs, when the latch jamb would be aligned to the edge of the shower door before anchoring it to an opposite channel piece. Out-of-plumb conditions in the plane of the closed shower door could be compensated for by adjustably sliding, in the plane of the door, the latch jamb within its supporting channel, or for that matter, the hinge jamb within its supporting channel. However, any out-of-plumb conditions in a plane transverse to the shower door could not so easily be corrected for: transverse plane adjustments had to be accurately determined prior to anchoring the last channel piece into place.

For example, after hanging a shower door, installing a conventional latch jamb to an adjacent wall using conventional hardware would typically include these installation instructions: the latch jamb must be paralleled with the edge of the door by moving the jamb's wall channel, with attached latch jamb, back and forth until the jamb surface of the latch jamb is as parallel with the inside of the glass as possible. The latch jamb and wall channel location is then marked on the wall by drawing a pencil line along the inside edge of the wall channel. The latch jamb is then removed from the wall channel and the wall channel aligned with the pencil mark, whereupon holes are marked, drilled, and the wall channel secured in place with expansion plugs. The latch jamb is then reset over the wall channel and adjusted, in the plane of the door only, for the best fit.

The difficulty with the above installation procedure is that the wall channel for the latch jamb has to be precisely aligned with the door before the jamb and door would properly meet; if the shower door assembly included a corner post joining a panel secured from a back wall, then any out-of-plumb condition of the back wall would likely give rise to a misalignment between the corner post (and in turn the latch jamb) and the edge of the closed shower door panel. Heretofore, no simple and final adjustment was possible in the plane transverse to the shower door to correct for this condition.

Another problem in aligning the latch jamb to the door's edge is that the shower doors, which are normally fabricated from tempered glass, often will have some warpage which creates gaps at the latch jamb.

Heretofore, correcting for such warpage, short of replacing the shower door, was practically impossible, since it would require bending of the latch jamb and wall channel to conform to the warpage before installation of the supporting channel pieces.

The present invention overcomes the above-described alignment problems between latch jamb and shower door, that is transverse plane alignment, by providing a latch jamb assembly mountable to a standard wall channel or corner piece, wherein the latch jamb assembly itself is easily adjustable in the transverse plane to accommodate any out-of-plumb condition of the shower enclosure hardware or to correct for warpage in the shower door itself. It is a feature of the present invention that the latch jamb can be conformed to the edge of the shower door after the wall channels and corner posts, if any, have been installed, thereby eliminating the need and difficulty of obtaining a precise alignment of wall mounted hardware of the shower door enclosure. The adjustable latch jamb assembly of the invention is easily adjusted as a final step of the installation to obtain a flush, water tight seal at the inner face between the shower door and latch jamb.

It can therefore be seen that the primary object of the present invention is to provide a latch jamb assembly for a shower door enclosure which permits the latch jamb to be adjusted in the transverse plane relative to the closed shower door to permit the latch jamb to be conformed easily to the edge of the shower door, and to do this adjustment as a final step of the shower installation.

SUMMARY OF THE INVENTION

The present invention is a door jamb assembly adjustable in a transverse plane comprised of a jamb member and separate jamb support. The jamb member has a jamb surface and an adjustment leg portion opposite the jamb surface which lies in a plane substantially transverse to the jamb surface. The separate jamb support, which will adjustably hold the jamb member, includes a jamb support base and a mounting frame structure for securing the jamb support to a wall channel or the like adjacent the door jamb. The base of the jamb support has a transversely oriented receiving slot opened to one side of, and extending laterally through, the base. The receiving slot is sized to permit the extending leg portion of the jamb member to slidably engage the receiving slot so as to constrain the movement of the door jamb member to the transverse plane of the slot. Means, such as adjustment screws, are provided for releasably securing the leg portion of the jamb member in a preadjusted position within the jamb support base receiving slot whereby the jamb member can first be conformed to the edge of the door by moving or bending the jamb member within the receiving slot and then locked it into this conformed position. It is contemplated that adjustment of the jamb member within the jamb support base receiving slot will be accomplished as a final step of the installation of the shower stall.

DETAILED DESCRIPTION OF THE PREFERRED EMBODIMENT

Figure 1:
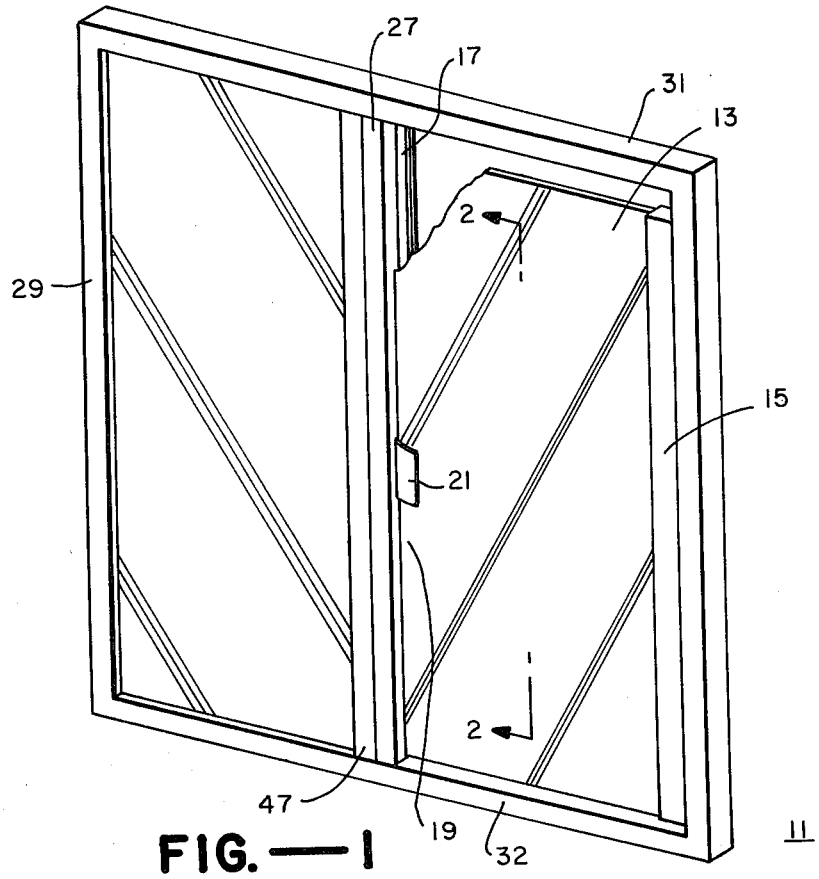
FIG. 1 of the drawings is a perspective view of a shower door framing structure generally illustrating the installation of an adjustable door jamb assembly made in accordance with the present invention.

Referring now to the drawings, FIG. 1 shows a mock-up shower door assembly, generally denoted by the numeral 11, wherein a glass shower door 13, swingably mounted to a hinge jamb 15, latches against a jamb member 17, hereinafter referred to as a latch jamb, when the door is in its closed position. The shower door 13 is normally held firmly against the latch jamb 17 by means of a conventional latch device (not shown) mounted at the swinging edge 19 of the the door adjacent the door handle 21. However, it is understood that the invention shall not be limited to a door having a latch, rather a latchless door may also be used in connection with the invention, such as a door simply having a spring loaded hinge.

Figure 2:
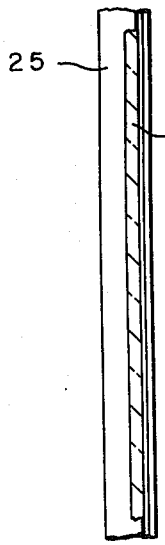
FIG. 2 is a partial cut away view of the framing structure of FIG. 1 taken along lines 2—2, illustrating the normal adjustment of a door jamb in the transverse plane where there is no out-of-plumb or warped condition in this plane.
Figure 3:
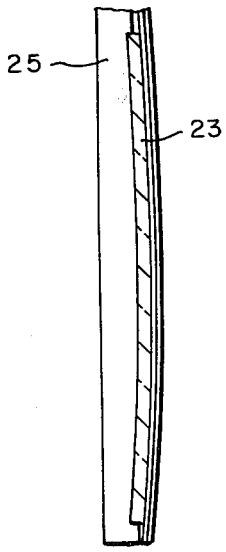
FIG. 3 is a partial cut away view of the framing structure of FIG. 1 taken along the lines 2—2, illustrating the adjustment of a door jamb to compensate for a warped condition in the shower door.
Figure 4:
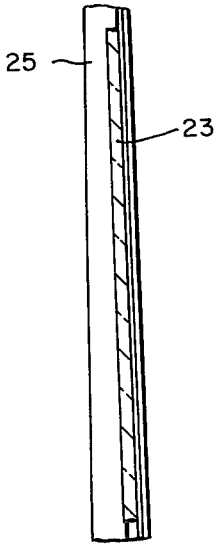
FIG. 4 is a partial cut away view of the framing structure of FIG. 1 taken along the lines 2—2, illustrating the adjustment of the door jamb to compensate for an out-of-plumb condition in a transverse plane.

As seen in FIGS. 2–4, the latch jamb 17 is provided with a sealing strip 23 fabricated of a rubberized material. The sealing strip 23 provides a water sealing jamb surface 25 for contacting the shower door 13 when it is closed, and when properly installed in accordance with the invention, the inside surface of the swinging edge 19 of the shower door will always lie flush against the sealing jamb surface 25 to provide a complete water seal. As to its installation, it should be observed that the adjustable latch jamb assembly 27 is installed as part of a shower door frame support structure 29 vertically between a header 31 and curb 32. As hereinafter described, the latch jamb 17 of the jamb assembly will be adjusted in a transverse plane to conform the latch jamb to the plane of the door, and if need be to the curvature of the door. The possible adjustments of the latch jamb in the transverse plane for providing proper sealing for different conditions are shown in FIGS. 2–4, wherein FIG. 2 shows the jamb's surface in a normal vertical orientation, FIG. 3 shows a jamb surface forced to a curvature to compensate for door warpage, and FIG. 4 shows the jamb surface inclined to pick up an out of plumb condition.

Figure 5:
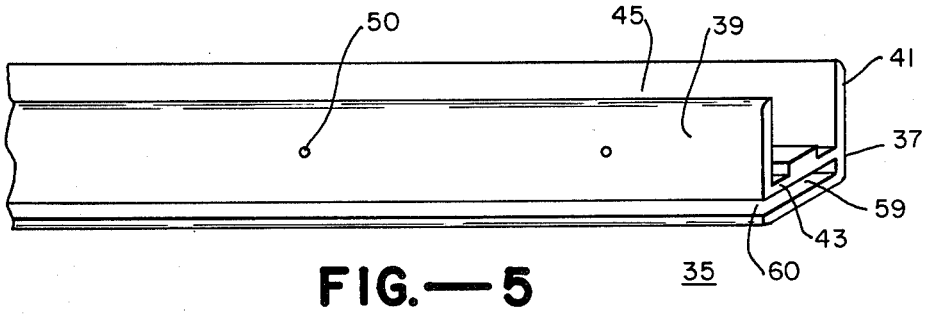
FIG. 5 is a partial perspective view of the separate jamb support of an adjustable door jamb assembly made in accordance with the invention.
Figure 6:
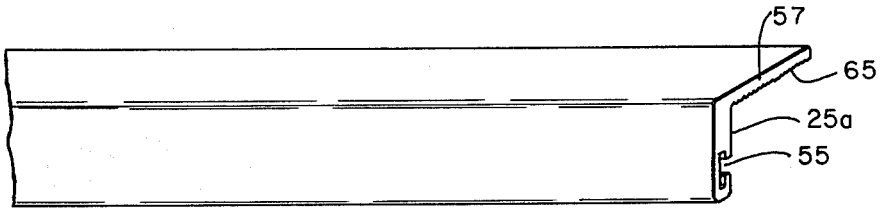
FIG. 6 is a partial perspective view of a separate door jamb member of an adjustable door jamb assembly made in accordance with the invention.
Figure 7:
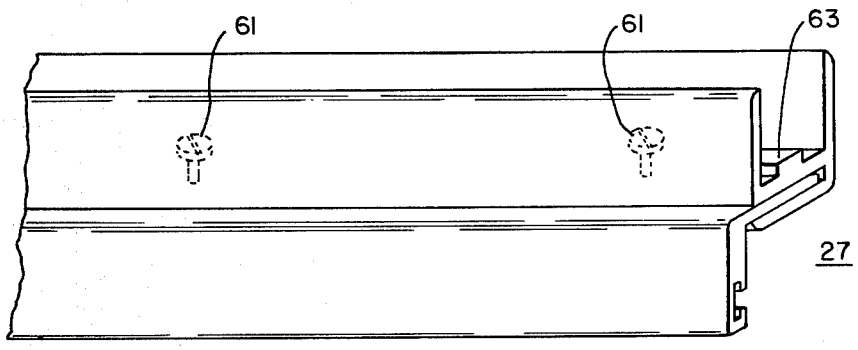
FIG. 7 is a partial perspective view of a door jamb assembly of the present invention showing the interlocking of the door jamb member and jamb support.
Figure 8:
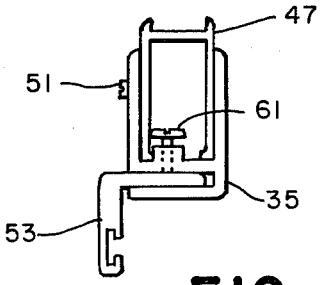
FIG. 8 is a side elevation view of the door jamb assembly shown in FIG. 7 mounted to a straight wall channel.
Figure 9:
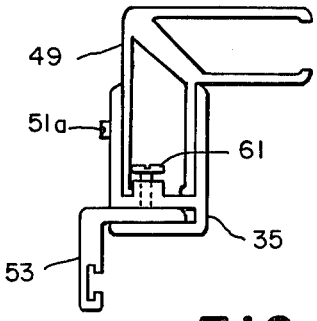
FIG. 9 is a side elevation view of the door jamb assembly of FIG. 7 mounted to a right angle channel which serves as a corner post.

FIGS. 5–8 best illustrate the latch jamb assembly 27 of the invention which is mountable in a suitable frame support structure, such as the mock-up frame support structure 29 of FIG. 1. Referring to FIG. 5, a separate jamb support 35 has an integral mounting frame structure in the form of a U-shaped channel 45 extending rearwardly from a jamb support base 37. As best illustrated in FIGS. 8 and 9, but also as illustrated in FIG. 1, the channel walls 39, 41 of the jamb support are designed to slip over an adjacent channel piece, such as channel 47 or corner post 49, whereby the jamb support can be locked into its substantially vertical position between the header 31 and curb 32 by locking screws 51, 51A. It is noted that by loosening the locking screws 51, 51A, the jamb support can be moved on the support channel or corner post, as the case may be, in the plane of the shower door, providing for any needed adjustment for out-of-plumb conditions in this plane. Adjustments in the transverse plane, however, are made in accordance with the invention as described below by means of a separate latch jamb member 53 which is separately illustrated in FIG. 6.

The latch jamb member 53 is a long and bendable metal strip of material which has a jamb surface, which in FIGS. 6–9 is denoted 25A, having a sealing strip containment slot 55, in which the sealing strip 23, shown in FIGS. 2–4, can be inserted. The jamb member, in addition to having an extended latch jamb surface, has an adjustment leg portion 57 located opposite the jamb surface which extends perpendicularly therefrom in a plane substantially transverse to the jamb surface. It can be seen that the latch jamb member in its preferred embodiment is an L-shaped strip with the adjustment leg portion 57 being formed by one leg of the L.

To hold the latch jamb member, support base 37 of the jamb support 35 includes a transversely oriented receiving slot 59 which extends laterally through the jamb support base from its open end 60 located below channel wall 39 toward the opposite channel wall 41 substantially over the full length of the jamb support base. The receiving slot 59 has a width and depth to permit the extending leg portion 57 of the jamb member to slidably engage the receiving slot to permit movement of the latch jamb member constraining that movement to a plane transverse to the jamb surface 25. Releasable securement means for securing the latch jamb member in the receiving slot 59 preferably take the form of adjustment screws 61 spaced along and tapped through the rib 63 formed on the channel end wall 43 on the inside of mounting channel 45. Since the channel end wall 43 also serves as the top wall of the receiving slot 59, it can be seen that the plurality of spaced adjustment screws 61, when tapped through the channel end wall, act to lock the latch jamb member in any pre-set position in the receiving slot when the screws are locked down against the extending leg portion 57 of the latch jamb member. Preferably, the jamb's extending leg portion 57 is provided with a serrated surface 65 to provide a better nonslip clamping action in the receiving slot when the adjustment screws 61 are tightened.

It is contemplated that both the latch jamb member 53 and jamb support 35 will be of uniform cross-section over their entire length and that these will be extruded parts, preferably extruded aluminum for light weight. It is further contemplated that, by using an extrusion fabricating process, the separate parts of the jamb assembly can be fabricated without substantial increases in cost as compared to a conventional unitary latch jamb of extruded aluminum, one with no transverse plane adjustment.

To install and adjust a latch jamb assembly in accordance with the invention, a shower door assembly, such by way of illustration as the assembly shown in FIG. 1, should first be completely installed except for the latch jamb assembly 27. Installing the latch jamb assembly is accomplished by loosely fitting the mounting channel 45 of the jamb support member over its supporting channel member, such as the support channel 47 or corner post 49 of FIGS. 8 and 9. With the adjustment screws 61 loosened to permit sliding of the latch jamb member 53 within the receiving slot 59, the shower door is then closed against the latch jamb so that the loosely held latch jamb conforms to the plane of the door. With this conforming adjustment, the entire latch jamb assembly 27 can be removed and the adjustment screws 61 on the inside of the mounting channel tightened to lock the latch jamb member in position. The entire assembly can thereafter be reinstalled and tightened down by channel wall locking screws 51.

If it is found that a warp condition in the shower door must be corrected for, the amount of bow required in the jamb to correct the warp can be visually prejudged, the latch jamb member bent or bowed to that prejudged condition, and the bow or bend locked into place by the tightening of the adjustment screws 61. Any further required adjustments to achieve a flush condition between the door and the jamb can be made by trial and error.

It is noted that the rib 63 which provides tapping strength for the adjustment screw 61 is preferably offset toward the channel wall 39 to the side of the opening 60 of the receiving slot 59. This permits maximum adjustment of the latch jamb within the receiving slot by permitting the extending leg portion 57 of the latch jamb to be substantially withdrawn from the receiving slot without losing contact with the adjustment screws 61.

Therefore, it can be seen that the present invention is a door jamb assembly adjustable in a transverse plane permitting the door jamb to be conformed to the plane of the door to correct for out-of-plumb conditions between the door jamb and the door due to normally occuring construction tolerances. The adjustable door jamb assembly of the invention permits a post installation alignment between the door jamb surface and the door which closes against it to provide a tight seal along this jamb surface.

Although this invention has been described above in considerable detail in the foregoing specification, it is not intended that the invention be limited to such detail, except as is necessitated by the language of the following claims. It should be particularly understood that that the adjustable latch jamb of the invention, while being described as used with a shower door can be used for other types of doors where adjustment in the transverse plane is desirable.

I claim:

1. A door jamb assembly adjustable in a transverse plane comprising a jamb member having a jamb surface lying substantially in the plane of said door when closed, and an adjustment leg portion opposite said jamb surface extending perpendicularly in a plane substantially transverse to said jamb surface, a jamb support including a jamb support base and a mounting frame structure, said jamb support base having a transversely oriented receiving slot open to one side of and extending laterally through said base, said receiving slot being sized to permit sliding engagement therein of the extending leg portion of said jamb member so that said jamb member can be moved relative to said jamb support in said receiving slot and so that such movement will be in a plane substantially transverse to said door jamb surface, means for releasably securing the leg portion of said jamb member in a fixed preadjusted position within said jamb support base receiving slot.

2. The door jamb assembly of claim 1 wherein said jamb member is "L"-shaped with one leg thereof forming said jamb surface and the other extending leg portion being releasably secured in the receiving slot of said jamb support base.

3. The door jamb assembly of claim 1 wherein said mounting frame structure of said jamb support is comprised of a U-shaped channel having rearwardly extending channel sidewalls of sufficient spacing to slidably engage and mount onto a suitable mating channel piece.

4. The door jamb assembly of claim 3 wherein the U-shaped channel of said jamb support has a end wall which also forms one wall of the receiving slot of the frame's jamb support base, and wherein said releasable securement means for the extending leg portion of said jamb member is comprised of adjustment screw means spaced along and taped through said channel end wall.

5. The door jamb assembly of claim 4 wherein the adjustment screws in said channel end wall are offset from the center of said U-shaped channel toward the open end of said receiving slot whereby the extending leg portion of said jamb member can be withdrawn substantially from said receiving slot without losing contact with said adjustment screws.

6. The door jamb assembly of claim 4 wherein a longitudinal rib extends down said channel on the end wall thereof and said adjustment screws are taped through said rib.

7. The door jamb assembly of claim 1 wherein at least one surface of the extended leg portion of said jamb member is serrated.

8. The door jamb assembly of claim 1 wherein said door jamb member and jamb support base are of uniform cross-section.

9. The door jamb assembly of claim 8 wherein said door jamb member and jamb support base are fabricated of extruded metal.

10. A door jamb assembly adjustable in a transverse plane comprising a vertical jamb member having an "L"-shaped cross-sectional shape with one leg thereof forming a jamb surface lying substantially in the plane of said door when closed and the other extending leg portion thereof having at least one serrated surface and lying in a plane substantially transverse to said jamb surface, a vertical jamb support having a jamb support base and a U-shaped channel mounting frame structure, said jamb support base having a transversely oriented receiving slot open to one side of and extending laterally through said base portion along the length thereof, said receiving slot being sized to permit sliding engagement therein of the extending leg portion of said jamb member so that said jamb member can be moved relative to said jamb support in said receiving slot and so that such movement will be in a plane transverse to said door jamb surface, and said channel mounting frame structure being formed by channel sidewalls extending rearwardly of said jamb support base and a channel end wall which forms one side of said jamb support base receiving slot, adjustment screws taped through said channel end wall for releasably securing therein the extending leg portion of said jamb member, said adjustment screws being offset from the center of said channel end wall toward the side of said jamb support frame to which said jamb member receiving slot is open.

11. The door jamb assembly of claim 10 wherein a longitudinal rib extends down said channel on the end wall thereof and said adjustment screws are taped through said rib.

* * * * *